US008004207B2

(12) United States Patent
Elder

(10) Patent No.: US 8,004,207 B2
(45) Date of Patent: Aug. 23, 2011

(54) LED DRIVER WITH PRECHARGE AND TRACK/HOLD

(75) Inventor: Joseph Scott Elder, Chandler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 407 days.

(21) Appl. No.: 12/326,963

(22) Filed: Dec. 3, 2008

(65) Prior Publication Data

US 2010/0134040 A1 Jun. 3, 2010

(51) Int. Cl.

| | |
|---|---|
| ***H05B 39/04*** | (2006.01) |
| ***H05B 41/36*** | (2006.01) |
| ***H05B 37/02*** | (2006.01) |
| ***G05F 1/00*** | (2006.01) |

(52) U.S. Cl. ..... 315/291; 315/185 R; 315/185 S; 315/307

(58) Field of Classification Search ..... None
See application file for complete search history.

(56) References Cited

U.S. PATENT DOCUMENTS

| | | | |
|---|---|---|---|
| 3,973,197 | A | 8/1976 | Meyer |
| 4,162,444 | A | 7/1979 | Rodgers |
| 4,615,029 | A | 9/1986 | Hu et al. |
| 4,649,432 | A | 3/1987 | Watanabe et al. |
| 4,686,640 | A | 8/1987 | Simison |
| 5,025,176 | A | 6/1991 | Takeno |
| 5,038,055 | A | 8/1991 | Kinoshita |
| 5,455,868 | A | 10/1995 | Sergent et al. |
| 5,508,909 | A | 4/1996 | Maxwell et al. |
| 5,723,950 | A | 3/1998 | Wei et al. |
| 6,002,356 | A | 12/1999 | Cooper |
| 6,281,822 | B1 | 8/2001 | Park |
| 6,864,641 | B2 | 3/2005 | Dygert |
| 6,943,500 | B2 | 9/2005 | LeChevalier |
| 7,262,724 | B2 | 8/2007 | Hughes et al. |
| 7,307,614 | B2 * | 12/2007 | Vinn ..... 345/102 |
| 7,391,280 | B2 | 6/2008 | Hsu |
| 7,436,378 | B2 | 10/2008 | Ito et al. |
| 7,511,545 | B1 | 3/2009 | Kesler |
| 2004/0208011 | A1 | 10/2004 | Horiuchi et al. |

(Continued)

FOREIGN PATENT DOCUMENTS

JP 2003332624 A 11/2003

(Continued)

OTHER PUBLICATIONS

Office Action—TS48276ZC NFOA Feb. 4, 2010, 11 pages.

(Continued)

*Primary Examiner* — Anh Q Tran

(57) ABSTRACT

A power source provides an output voltage to drive a plurality of light emitting diode (LED) strings. A feedback controller monitors the tail voltages of the LED strings to identify the minimum tail voltage and adjusts the output voltage based on a relationship between the minimum tail voltage and a reference voltage. The feedback controller implements precharging of the output voltage, including one or both of short-term precharging or long-term precharging. Further, the feedback controller incorporates a track/hold circuit that tracks the minimum tail voltage while the LED strings are active and holds the minimum tail voltage at the last tracked minimum tail voltage while the LED strings are inactive and uses the held minimum tail voltage for controlling the output voltage while the LED strings are inactive so as to permit the power source to supply an appropriate output voltage when the LED strings are subsequently activated again.

20 Claims, 3 Drawing Sheets

U.S. PATENT DOCUMENTS

| | | | | |
|---|---|---|---|---|
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0253330 | A1 | 11/2007 | Tochio et al. | |
| 2008/0054815 | A1 | 3/2008 | Kotikalapoodi | |
| 2008/0297067 | A1 | 12/2008 | Wang et al. | |
| 2009/0108775 | A1 * | 4/2009 | Sandner et al. | 315/297 |
| 2009/0128045 | A1 | 5/2009 | Szczeszynski et al. | |
| 2009/0187925 | A1 | 7/2009 | Hu et al. | |
| 2009/0230874 | A1 | 9/2009 | Zhao et al. | |
| 2009/0230891 | A1 | 9/2009 | Zhao et al. | |
| 2009/0273288 | A1 | 11/2009 | Zhao et al. | |
| 2009/0315481 | A1 | 12/2009 | Zhao | |
| 2010/0026203 | A1 | 2/2010 | Zhao et al. | |
| 2010/0085295 | A1 | 4/2010 | Zhao et al. | |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

Office Action—TS48276ZC NOA Jun. 2, 2010, 7 pages.
Office Action—TS48276ZC NOA Jul. 9, 2010, 12 pages.
International App. No. PCT/US2009/065913, Search Report mailed Jul. 7, 2010, 4 pages.
MC Nerney, Tim, "constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.
Maxim: "Application Note 810, Understanding Flash ADCs," Oct. 2, 2001, 8 pages.
National Semiconductor Data Sheet: "LM3432/LM3432B 6-Channel Current Regulator for LED Backlight Application," May 22, 2008, pp. 1-18.
U.S. Appl. No. 12/537,443, filed Aug. 7, 2009, entitled Pulse Width Modulation Frequency Conversion'.
U.S. Appl. No. 12/703,239, filed Feb. 10, 2010, entitled "Pulse Width Modulation With Effective High Duty Resolution".
U.S. Appl. No. 12/537,692, filed Aug. 7, 2009, entitled "Phase-Shifted Pulse Width Modulation Signal Generation".
U.S. Appl. No. 12/625,818, filed Nov. 25, 2009, entitled "Synchronized Phase-Shifted Pulse Width Modulation Signal Generation".
U.S. Appl. No. 12/703,249, filed Feb. 10, 2010, entitled "Duty Transition Control in Pulse Width Modulation Signaling".
Luke Huiyong Chung, Electronic Products: "Driver ICs for LED BLUs," May 1, 2008, 3 pages.
Akira Takahashi, Electronic Products: "Methods and features of LED drivers," Mar. 2008, 3 pages.
U.S. Appl. No. 12/340,985, filed Dec. 22, 2008, entitled "LED Driver With Feedback Calibration".
Texas Instruments Publication, "Interleaved Dual PWM Controller with Programmable Max Duty Cycle," SLUS544A, (UCC28220, UCC28221) Sep. 2003, pp. 1-28.
U.S. Appl. No. 12/367,672, filed Feb. 9, 2009, entitled "Configuration for Dynamic Power Control in LED Displays".
U.S. Appl. No. 12/424,326, filed Apr. 15, 2009, entitled "Peak Detection With Digital Conversion".
U.S. Appl. No. 12/504,841, filed Jul. 17, 2009, entitled "Analog-To-Digital Converter With Non-Uniform Accuracy".
U.S. Appl. No. 12/690,972, filed Jan. 21, 2010, entitled "Serial Cascade of Minimum Tail Voltages of Subsets of LED Strings for Dynamic Power Contrl in LED Displays".
U.S. Appl. No. 12/363,607, filed Jan. 30, 2009, entitled "LED Driver With Dynamic Headroom Control".
International Application No. PCT/US2009/035284, Search Report and Written Opinion, Oct. 28, 2009, 11 pages.
PCT Application No. PCT/US2010/028289; Search Report and Written Opinion dated Dec. 15, 2010.

* cited by examiner

LED DRIVER WITH PRECHARGE AND TRACK/HOLD

FIELD OF THE DISCLOSURE

The present disclosure relates generally to light emitting diodes (LEDs) and more particularly to LED drivers.

BACKGROUND

Light emitting diodes (LEDs) often are used for backlighting sources in liquid crystal displays (LCDs) and other displays. In backlighting implementations, the LEDs are arranged in parallel "strings" driven by a shared power source, each LED string having a plurality of LEDs connected in series. To provide consistent intensity and color emanating from the LED strings, each LED string typically is driven at a regulated current that is substantially equal among all of the activated LED strings.

Although driven by regulated currents of equal magnitude, there often is considerable variation in the bias voltages needed to drive each LED string due to variations in the static forward-voltage drops of individual LEDs of the LED strings resulting from process variations in the fabrication and manufacturing of the LEDs. Dynamic variations due to changes in temperature when the LEDs are enabled and disabled also can contribute to the variation in bias voltages needed to drive the LED strings with a fixed current. The lowest cathode voltage, or tail voltage, of all the activated LED strings typically must be sufficiently positive in order to properly regulate the currents through the activated LED strings. The variation in the voltage drops across the LED strings gives rise to the potential for the tail voltage of one or more LED strings to fall below the minimum voltage necessary for proper current regulation. Further, the output voltage provided by a power source driving the LED strings typically exhibits transient voltage droop when subjected to the pulsed current load that typically occurs in pulse width modulation (PWM)-based LED backlighting systems.

To account for both the variation in forward voltages between LED strings and the transient voltage droop in the output voltage, conventional LED drivers typically provide a fixed voltage that is sufficiently higher than an expected worst-case bias drop and transient voltage droop so as to ensure proper operation of each LED string. However, as the power consumed by the LED driver and the LED strings is a product of the output voltage of the LED driver and the sum of the currents of the individual activated LED strings, the use of an excessively high output voltage by the LED driver unnecessarily increases power consumption by the LED driver. Accordingly, an improved technique for driving LED strings would be advantageous.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-4 illustrate example techniques for power management in a light emitting diode (LED) system having a plurality of LED strings. A power source provides an output voltage to drive the LED strings. A feedback controller of an LED driver monitors the tail voltages of the LED strings to identify the minimum, or lowest, tail voltage and adjusts the output voltage of the power source based on a relationship between the lowest tail voltage and a reference voltage. In at least one embodiment, the LED driver implements precharging of the output voltage of the power source to compensate for transient voltage droop. This precharging can include a short-term, or transient, precharging whereby the reference voltage is temporarily increased so as to cause the power source to temporarily increase the output voltage in response. The precharging also can include a long-term precharging whereby the output voltage can be adjusted responsive to changes in an average duty ratio of the pulse width modulation (PWM) data used to control activation of the LED strings. Further, in one embodiment, the feedback controller incorporates a track/hold circuit that tracks the minimum tail voltage while the LED strings are active and then holds the minimum tail voltage at the last tracked voltage while the LED strings are inactive so as to permit the power source to supply an appropriate output voltage in anticipation of the subsequent activation of the LED strings for the next PWM cycle.

The term "LED string," as used herein, refers to a grouping of one or more LEDs connected in series. The "head end" of a LED string is the end or portion of the LED string that receives a driving voltage and the "tail end" of the LED string receives a resulting driving current. The term "tail voltage," as used herein, refers to the voltage at the tail end of a LED string or representation thereof (e.g., a voltage-divided representation, an amplified representation, etc.).

Figure 1:
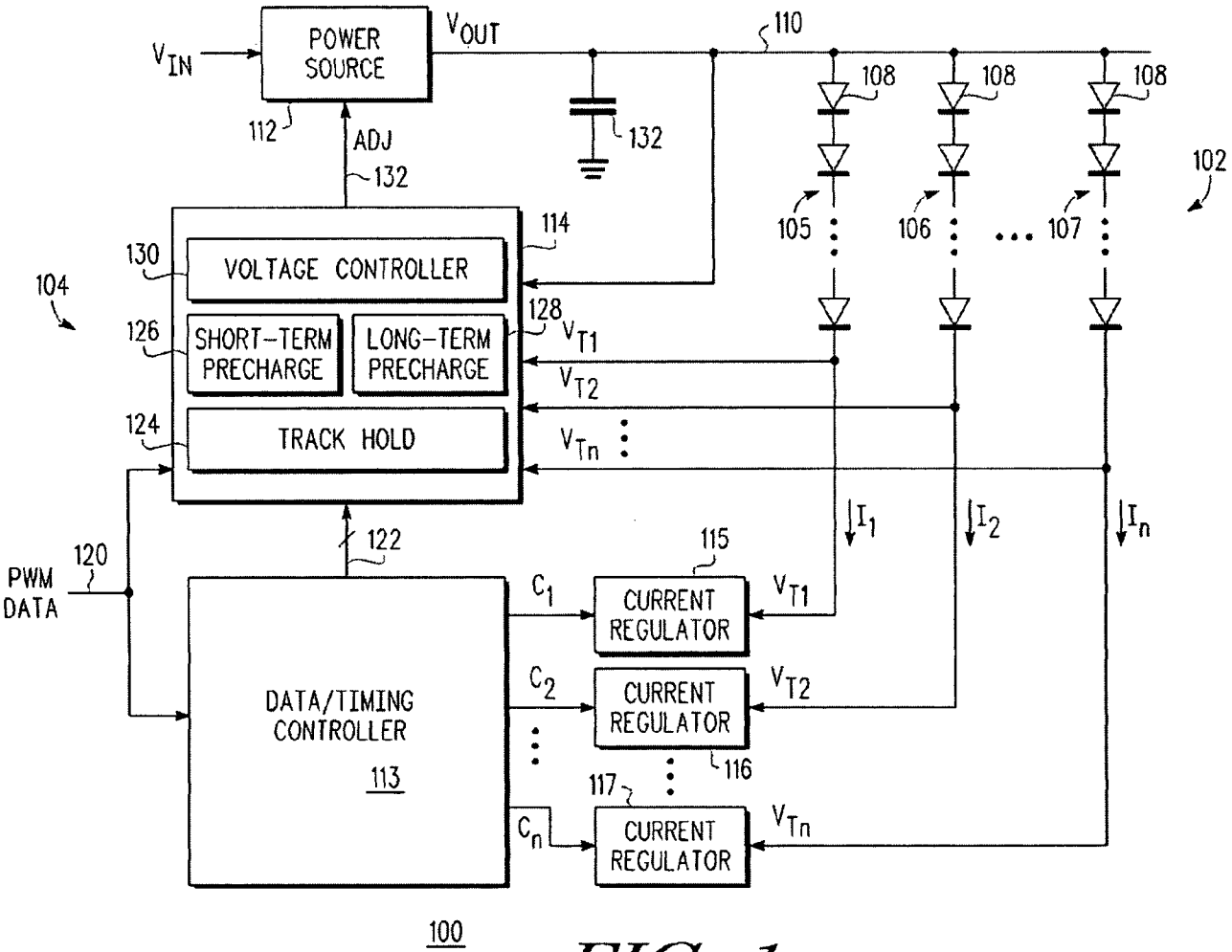
FIG. 1 is a diagram illustrating a light emitting diode (LED) system having dynamic power management with precharge and track/hold schemes in accordance with at least one embodiment of the present disclosure.

FIG. 1 illustrates a LED system 100 having dynamic power management in accordance with at least one embodiment of the present disclosure. In the depicted example, the LED system 100 includes a LED panel 102, a LED driver 104, and a power source 112 for providing an adjustable output voltage ($V_{OUT}$) to drive the LED panel 102. The LED panel 102 includes a plurality of LED strings (e.g., LED strings 105, 106, and 107). Each LED string includes one or more LEDs 108 connected in series. The LEDs 108 can include, for example, white LEDs, red, green, blue (RGB) LEDs, organic LEDs (OLEDs), etc. Each LED string is driven by the adjustable voltage $V_{OUT}$ received at the head end of the LED string via a voltage bus 110 (e.g., a conductive trace, wire, etc.). In the embodiment of FIG. 1, the power source 112 is implemented as a voltage regulator (e.g., a boost converter) configured to drive the output voltage $V_{OUT}$ using an input voltage $V_{IN}$.

The LED driver 104 includes a data/timing controller 113 and a feedback controller 114 configured to control the power source 112 based on the tail voltages at the tail ends of the LED strings 105-107. The LED driver 104 further includes a plurality of current regulators (e.g., current regulators 115, 116, and 117) to regulate the currents through the LED strings 105-107. In the example of FIG. 1, the current regulator 115 is configured to maintain the current $I_1$ flowing through the LED string 105 at or near a fixed current (e.g., 30 mA) when active. Likewise, the current regulators 116 and 117 are configured to maintain the current $I_2$ flowing through the LED string 106 when active and the current $I_n$ flowing through the LED string 107 when active, respectively, at or near the fixed current. The LED driver 104 can be implemented as a single integrated circuit (IC) package, whereby the power source 112 can be implemented as part of the IC package, or implemented partially or entirely separate from the IC package.

As described in greater detail below, the LED driver 104, in one embodiment, receives pulse width modulation (PWM) data 120 that identifies or controls which of the LED strings 105-107 are to be activated and at what times during corresponding PWM cycles, and the LED driver 104 is configured to activate the LED strings 105-107 at the appropriate times in their respective PWM cycles based on the PWM data. For purposes of discussion, the PWM data 120 is described as signaling the activation of one or more of the LED strings 105-107 when the PWM data is in a "high" state (e.g., logic 1) and as signaling the deactivation (or non-activation) of all of the LED strings 105-107 when the PWM data 120 is in a "low" state (e.g., logic 0). However, in other implementations the converse relationship between the "high" and "low" states of the PWM data 120 and the activation and deactivation of the LED strings 105-107 could be implemented. The data/timing controller 113 is configured to provide control signals to the other components of the LED driver 104 based on the timing and activation information represented by the PWM data 120. To illustrate, the data/timing controller 113 provides control signals $C_1$, $C_2$, and $C_n$ to the current regulators 115, 116, and 117, respectively, to control activation and deactivation of current flow through the LED strings 105-107 during the corresponding states of the respective PWM cycles of the PWM data 120. The data/timing controller 113 also provides control signals 122 to the components of the feedback controller 114 so as to control the operation and timing of these components.

The feedback controller 114 includes a track/hold circuit 124, a short-term precharge circuit 126, a long-term precharge circuit 128, a voltage controller 130, and a plurality of tail inputs adapted to be coupled to the tail ends of the LED strings 105-107 to receive the tail voltages $V_{T1}$, $V_{T2}$, and $V_{Tn}$ of the LED strings 105, 106, and 107, respectively. The feedback controller 114 is configured to identify or detect the minimum, or lowest, tail voltage $V_{Tmin}$ of the LED strings 105-107 and the voltage controller 130 is configured to generate a signal ADJ (signal 132) based on a relationship between a reference voltage $V_{TIN}$ based on the minimum tail voltage $V_{Tmin}$ and another reference voltage $V_{REF}$ representative of a minimum threshold voltage for the tail voltages of the LED strings 105-107. The power source 112, in turn, is configured to adjust the output voltage $V_{OUT}$ responsive to the signal ADJ. In one embodiment, the voltage controller 130 configures the signal ADJ so as to direct the power source 112 to increase the output voltage $V_{OUT}$ responsive to determining that the reference voltage $V_{TIN}$ is less than the reference voltage $V_{REF}$ and, conversely, configures the signal ADJ so as to direct the power source 112 to decrease the output voltage $V_{OUT}$ responsive to determining that the reference voltage $V_{TIN}$ is greater than the reference voltage $V_{REF}$. An example implementation of the voltage controller 130 is described below with reference to FIG. 2.

In view of the potential for a transient voltage droop of the output voltage $V_{OUT}$ due to the pulsed activation of the LED strings 105-107 as controlled by the PWM data 120, the feedback controller 114 utilizes one or both of the short-term precharge circuit 126 and the long-term precharge circuit 128 so as to boost the output voltage VOUT to counteract this transient voltage droop. As discussed above, the voltage controller 130 signals the power source 112 to control the output voltage $V_{OUT}$ based on the relationship between the voltage $V_{REF}$ and the reference voltage $V_{TIN}$. In one embodiment, the short-term precharge circuit 126 is configured to make use of this relationship so as to temporarily increase the output voltage $V_{OUT}$. Prior to activation of one or more of the LED strings 105-107 (e.g., while the PWM data 120 is in the "low" state), the short-term precharge circuit 126 temporarily increases the reference voltage $V_{REF}$, which changes the relationship between the reference voltage $V_{REF}$ and the reference voltage $V_{TIN}$, which in turn spurs the voltage controller 130 to direct the power source 112 to increase the output voltage $V_{OUT}$. As the output voltage $V_{OUT}$ is increased prior to activation of the LED strings 105-107, the output voltage $V_{OUT}$ can experience a certain degree of voltage droop while maintaining the tail voltages of the LED strings 105-107 at a sufficiently positive voltage to permit proper current regulation by the current regulators 115-117. To illustrate, the power source 112 typically implements a substantial capacitor 132 that is connected to the voltage bus 110. The temporary increase in the output voltage $V_{OUT}$ while the LED strings are inactive permits additional charge to be stored in the capacitor 132. Thus, when one or more of the LED strings 105-107 are subsequently activated, additional charge is available from the capacitor 132 to power the active LED strings and thus maintain sufficient voltage at the tail end of the active strings such that the driving currents sources are not destabilized. An example implementation of the short-term precharge circuit 126 is described below with reference to FIG. 2.

In addition to, or instead of, providing for a temporary precharge effect for the output voltage $V_{OUT}$, the long-term precharge circuit 128 can adjust the output voltage to compensate for longer term changes in the LED string voltage. Modern LEDs have multiple thermal time constants associated with their physical construction. The thermal time constants in association with power or thermal changes in the LED affect the required forward voltage for a given forward current. While the forward voltage changes associated with the short term thermal time constants can be managed with a temporary, or cycle-by-cycle, precharge, larger precharge voltages may be necessary for idle times much longer than a PWM cycle. For example, in the case where an LED string may be disabled for a sufficient period of time such that the light emitting semiconductor junctions of the LEDs have cooled to the local ambient temperature, the required forward voltage of the LED string might be several volts larger than was necessary at the last held voltage of the track and hold. This is in contrast to the short term forward voltage changes that are more typically hundreds of millivolts for a similar string.

In one embodiment, the long-term precharge circuit 128 provides this long-term precharge effect by averaging the PWM duty ratio of the PWM data 120 over a predetermined averaging window and then causing the voltage controller 130 to adjust the output voltage $V_{OUT}$ in view of the averaged PWM duty ratio of the PWM data 120. For example, consider an operational situation whereby a PWM duty ratio collapses from 100% to 0% and stays at 0% for an averaging window of several seconds. The forward voltage requirements when the LED string is reactivated can then be substantially different from that required during the last activation and require a VOUT 110 precharge of 4V or more. An example implementation of the long-term precharge circuit 128 is described below with reference to FIG. 2.

As noted above, the voltage controller 130 controls the power source 112 to adjust the output voltage VOUT based on the relationship between the reference voltage $V_{REF}$ and the reference voltage $V_{TIN}$ that represents the minimum tail voltage $V_{Tmin}$ of the tail voltages of the LED strings 105-107. However, when all of the LED strings 105-107 are inactive (e.g., the PWM data 120 is in the "low" state), the tail voltages of the LED strings are pulled substantially closer to the output voltage $V_{OUT}$ (e.g., pulled to approximately 10-15 V), and thereby distorting the relationship between the reference voltage $V_{REF}$ and the minimum tail voltage $V_{Tmin}$. This distorted relationship can result in a reduction in the output voltage $V_{OUT}$ while the LED strings are inactive/deactivated and thus the output voltage $V_{OUT}$ may not be sufficiently high to properly drive the LED strings when they are subsequently activated. Accordingly, in at least one embodiment, the track/hold circuit 124 is configured to operate in a track mode while one or more of the LED strings 105-107 are activated (or able to be activated) and operate in a hold mode while the LED strings 105-107 are deactivated. In this mode, the track/hold circuit 124 tracks the minimum tail voltage $V_{Tmin}$ in parallel with the use of the minimum tail voltage $V_{Tmin}$ by the voltage controller 130 in controlling the output voltage $V_{OUT}$. In the hold mode, the track/hold circuit 124 holds the last tracked minimum tail voltage and provides this last tracked minimum tail voltage to the voltage controller 130 in place of the actual minimum tail voltage of the LED strings for use by the voltage controller 130 in controlling the output voltage $V_{OUT}$. As the feedback controller 114 maintains the output voltage $V_{OUT}$ so that the resulting minimum tail voltage $V_{Tmin}$ is sufficiently positive to permit effective current regulation for the LED strings 105-107, the last tracked minimum tail voltage at the end of an active period of the LED strings is representative of an appropriate starting level of the output voltage $V_{OUT}$ for the next active period of the LED strings. By holding this last tracked minimum tail voltage during the inactive period between active periods and using the held minimum tail voltage to control the output voltage $V_{OUT}$ during the inactive period, the output voltage $V_{OUT}$ can be maintained at an appropriate level when the next active period of the LED strings is initiated. An example implementation of the track/hold circuit 124 is described below with reference to FIG. 2.

Figure 2:
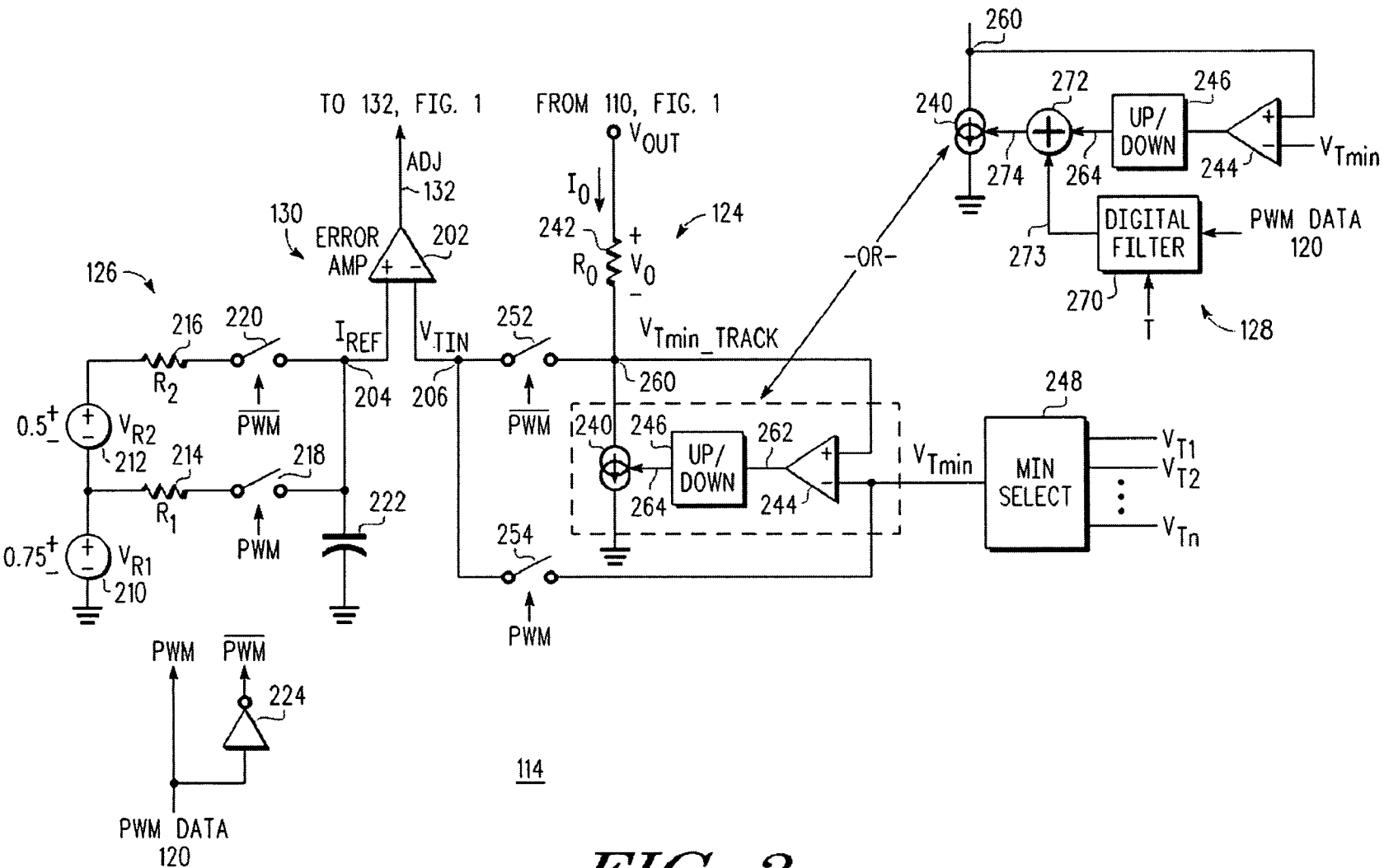
FIG. 2 is a circuit diagram illustrating an example implementation of a feedback controller of a LED driver of the LED system of FIG. 1 in accordance with at least one embodiment of the present disclosure.

FIG. 2 illustrates an example implementation of the track/hold circuit 124, the short-term precharge circuit 126, the long-term precharge circuit 128, and the voltage controller 130 of the feedback controller 114 of FIG. 1 in accordance with at least one embodiment of the present disclosure. Although FIG. 2 illustrates one particular implementation, other implementations of the feedback controller 114, and its components, can be used based on the guidance provided herein without departing from the scope of the present disclosure.

In the depicted example, the voltage controller 130 is implemented as an error amplifier 202 comprising an input coupled to a node 204 to receive the reference voltage $V_{REF}$, an input coupled to a node 206 to receive the reference voltage $V_{TIN}$, and an output to provide the signal ADJ (signal 132), whereby the error amplifier 202 configures the signal ADJ based on the relationship between the voltage $V_{REF}$ at the node 204 and the voltage $V_{TIN}$ at the node 206. In particular, the error amplifier 202 configures the magnitude and polarity of the signal ADJ based on the difference between the voltage $V_{REF}$ and the voltage $V_{TIN}$.

The short-term precharge circuit 126 is implemented with voltage sources 210 and 212, resistors 214 and 216, switches 218 and 220, and capacitor 222. The voltage source 210 comprises a cathode electrode coupled to a ground reference and an anode electrode to provide a first voltage $V_{R1}$ (e.g., 0.75 V). The voltage source 212 comprises a cathode electrode coupled to the anode electrode of the voltage source 210 and an anode electrode to provide a second voltage $V_{R2}$ (e.g., 0.5 V) such that the total voltage at the anode electrode of the voltage source 212 is $V_{R1}+V_{R2}$ (e.g., 1.25 V). The resistor 214 comprises a first electrode coupled to the anode of the voltage source 210 and a second electrode. The resistor 216 comprises a first electrode coupled to the anode of the voltage source 212 and a second electrode. The switch 218 comprises a first electrode coupled to the second electrode of the resistor 214 and a second electrode coupled to the node 204. The switch 220 comprises a first electrode coupled to the second electrode of the resistor 216 and a second electrode coupled to the node 204. The switch 218 is controlled by the PWM data signal 120 ("PWM) and the switch 220 is controlled by the complementary representation ("/PWM") of the PWM data signal 120 (generated by, for example, an inverter gate 224). The capacitor 222 comprises a first electrode coupled to the node 204 and a second electrode coupled to the ground reference.

In operation, the switch 218 is closed (conductive) and the switch 220 is open (non-conductive) when the PWM data 120 is in the "high" state, thereby connecting the output of the voltage reference 210 to the node 204 such that the voltage $V_{R1}$ is supplied as the voltage $V_{REF}$ to the error amplifier 202. Conversely, when the PWM data 120 is in the "low" state, the switch 218 is open and the switch 220 is closed, thereby connecting the output of the voltage reference 212 to the node 204 such that the voltage $V_{R1}+V_{R2}$ is supplied as the voltage $V_{REF}$ to the error amplifier 202.

As the "low" state and the "high" state of the PWM data 120 signify the deactivated state and the activated states, respectively, of the LED strings 105-107, the precharge circuit 126 operates so as to supply the voltage $V_{R1}$ as the reference voltage $V_{REF}$ when the LED strings are active and to supply the voltage $V_{R1}+V_{R2}$ as the reference voltage $V_{REF}$ when the LED strings are inactive. Thus, the voltage $V_{R1}$ acts as the minimum threshold for the minimum tail voltage $V_{Tmin}$ to ensure proper current regulation of the LED strings 105-107. Supplying the higher voltage $V_{R1}+V_{R2}$ as the reference voltage $V_{REF}$ causes an increase in the output voltage $V_{OUT}$, and thus the action of switching in the voltage $V_{R1}+V_{R2}$ in place of the voltage $V_{R1}$ for the reference voltage $V_{REF}$ while the LED strings 105-107 are inactive acts to precharge the output voltage $V_{OUT}$ in anticipation of the upcoming activation of one or more of the LED strings 105-107.

Further, it will be appreciated that the sequential connection of the resistor 214 and the capacitor 222 via the switch 218 creates an R-C circuit having a time constant of $R_1C$ (whereby $R_1$ represents the resistance of the resistor 214 and C represents the capacitance of the capacitor 222). Likewise, the sequential connection of the resistor 216 and the capacitor 222 via the switch 220 creates an R-C circuit having a time constant of $R_2C$ (whereby $R_2$ represents the resistance of the resistor 216). As discussed in greater detail below with reference to FIG. 4, it typically is desirable to have the voltage $V_{REF}$ switch quickly from the voltage $V_{R1}$ to the increased voltage $V_{R1}+V_{R2}$ when initiating precharging, and, in contrast, to have the voltage $V_{REF}$ degrade slowly from the voltage $V_{R1}+V_{R2}$ back to the voltage $V_{R1}$ when terminating precharging. Accordingly, in one embodiment, the resistance $R_1$ is set to a relatively high resistance so that the time constant $R_1C$ is relatively high and the resistance $R_2$ is set to a relatively low resistance so that the time constant $R_2C$ is relatively low. To illustrate, a resistance $R_1$ of 500 kΩ), a resistance $R_2$ of 50 kΩ), and a capacitance C of 10 pF have been found to be appropriate values in certain instances, although other values can be used without departing from the scope of the present disclosure.

In the depicted example of FIG. 2, the track/hold circuit 124 is implemented via a current digital-to-analog converter (DAC) 240, a resistor 242, a comparator 244, an up/down counter 246, a minimum select circuit 248, and switches 252 and 254. The minimum select circuit 248 includes a plurality of inputs adapted to be coupled to the tails of the LED strings 105-107 (FIG. 1) and an output to provide the minimum tail voltage $V_{Tmin}$ of the tail voltages of the LED strings 105-107. The minimum select circuit 248 can be implemented as, for example, a diode OR circuit. The resistor 242 includes a first electrode coupled to the voltage bus 110 (FIG. 1) to receive the output voltage $V_{OUT}$ and a second electrode coupled to a node 260. The switch 252 includes a first electrode coupled to the node 206 and a second electrode coupled to the node 260. The switch 254 includes a first electrode coupled to the node 206 and a second electrode coupled to the output of the minimum select circuit 248. The switch 252 is controlled by the complementary /PWM signal and the switch 254 is controlled by the PWM signal. The comparator 244 includes an input coupled to the output of the minimum select circuit 248, an input coupled to the node 260, and an output to provide a control signal 262 representative of the relationship between the minimum tail voltage $V_{Tmin}$ output by the minimum select circuit 248 and a voltage $V_{Tmin_track}$ at the node 260. The up/down counter 246 includes an input to receive the control signal 262 and an output to provide a count value 264, whereby the up/down counter 246 is configured to increment or decrement the count value 264 based on the polarity of the control signal 262. The current DAC 240 includes an electrode coupled to the node 260, an electrode coupled to the ground reference, and a control input to receive the count value 264. The current DAC 240 is configured to drive a current $I_0$ through the node 260 (and thus through the resistor 242), whereby the magnitude of the current $I_0$ is controlled by the received count value 264.

In operation, the states of the PWM data 120 configure the track/hold circuit 124 to cycle between a track mode and a hold mode. The minimum select circuit 248 continuously monitors the tail voltages of the LED strings 105-107 and provides the lowest current tail voltage as the minimum tail voltage $V_{Tmin}$. In the track mode (while the PWM data 120 is in the "high" state), the switch 252 is open and the switch 254 is closed, and thus the voltage $V_{Tmin}$ output by the minimum select circuit 248 is provided as the reference voltage $V_{TIN}$ to the error amplifier 202 via the node 206. Thus, in this mode the error amplifier 202 is comparing the current minimum tail voltage $V_{Tmin}$ with the reference voltage $V_{REF}$ provided by the short-term precharge circuit 126 to control the output voltage $V_{OUT}$. In parallel, the comparator 244 controls the up/down counter 246 to adjust the count value 264 based on the relationship between the voltage at the node 260 and the minimum tail voltage $V_{Tmin}$. The adjustment to the counter value 264 in turn adjusts the magnitude of the current $I_0$ generated by the current DAC 240, which in turn adjusts the voltage drop $V_0$ across the resistor 242 and thus adjusts the voltage $V_{Tmin_track}$ at the node 260. In this manner, the track/hold circuit 124 adjusts the voltage $V_{Tmin_track}$ at the node 260 so as to track the minimum tail voltage $V_{Tmin}$ while the track/hold circuit 124 is in the track mode.

When the PWM data 120 transitions to the "low" state, the track/hold circuit 126 transitions to the hold mode. In the hold mode, the switch 254 is open and the switch 252 is closed. Further, the up/down counter 246 is configured so as to maintain its current count value 264, which in turn causes the current DAC 240 to maintain the current $I_0$ and thereby hold the last tracked minimum tail voltage $V_{Tmin_track}$ at the node 260 for the duration of the hold mode. Further, this held minimum tail voltage $V_{Tmin_track}$ is provided via the switch 252 to the node 206 as the reference voltage $V_{TIN}$ used by the error amplifier 202 to control the output voltage $V_{OUT}$. When the PWM data 120 transitions back to the "high" state, the up/down counter 246 is reconfigured to permit adjustment to the count value 246 and the switches 252 and 254 are reconfigured as described above.

As the operation of the track/hold circuit 124 illustrates, while in the track mode, the minimum tail voltage $V_{Tmin}$ is provided as the voltage $V_{TIN}$ for controlling the output voltage $V_{OUT}$ and the track/hold circuit 124 uses the voltage drop across the resistor 242 (which represents the largest voltage drop across the LED strings 105-107 when the LED strings 105-107 are activated) to track the voltage at the node 206 to the minimum tail voltage $V_{Tmin}$ in a separate path. When the LED strings 105-107 are deactivated, the minimum tail voltage $V_{Tmin}$ of the LED strings 105-107 increases to near the output voltage $V_{OUT}$ because the LED strings 105-107 are no longer conducting current. If a minimum tail voltage $V_{Tmin}$ near the voltage $V_{OUT}$ was to be supplied to the error amplifier 202 as the voltage $V_{TIN}$, the error amplifier 202 would adjust the output voltage $V_{OUT}$ significantly downward until the output voltage $V_{OUT}$ was near the reference voltage $V_{REF}$. In this instance, the power source 112 (FIG. 1) would be unable to raise the output voltage $V_{OUT}$ to the appropriate level quickly enough once the LED strings 105-107 are reactivated, and thus the LED strings 105-107 could exhibit spurious operation because the supplied voltage is insufficient for proper current regulation. The track/hold circuit 124 avoids this situation by providing the last tracked minimum tail voltage $V_{Tmin_track}$ as the voltage $V_{TIN}$, which in turn causes the error amplifier 202 to maintain the output voltage $V_{OUT}$ at a level not less than the level for the output voltage $V_{OUT}$ that was present when the LED strings ended their active period.

As noted above, the feedback controller 114 also can implement a long-term precharge circuit 128 to provide precharging of the output voltage $V_{OUT}$ in addition to, or instead of, the transient precharging afforded by the short-term precharge circuit 126. FIG. 2 illustrates two example embodiments of the long-term precharge circuit 128 (the two alternate implementations identified by the "-OR-" in FIG. 2). In one embodiment, the long-term precharge circuit 128 can be implemented via a digital filter 270 and a summer 272 incorporated into the track/hold circuit 124 as illustrated by FIG. 2. In this implementation, the digital filter 270 includes an input to receive the PWM data 120, an input to receive value T representative of an averaging window, and an output to provide a precharge count 273. The value T can be provided via a register or other memory location, hardcoded in the digital filter 270, indicated as a voltage from a resistor divider, and the like. In operation, the digital filter 270 implements a counter (not shown) to determine an average duty ratio of the PWM data 120 over an averaging window defined by the value T and provides the precharge count 273 based on this average duty ratio (as represented by the count of the counter). The summer 272 sums the count value 264 and the precharge count 273 and provides the resulting modified count value 274 to the current DAC 240 to control the magnitude of the current $I_0$ driven by the current DAC 240. As an increase in the current $I_0$ results in a decrease in the voltage at the node 260 and vice versa, the long-term precharge circuit 128 acts to precharge the output voltage $V_{OUT}$ (by decreasing the voltage $V_{TIN}$) relative to averaged PWM duty ratio.

Figure 3:
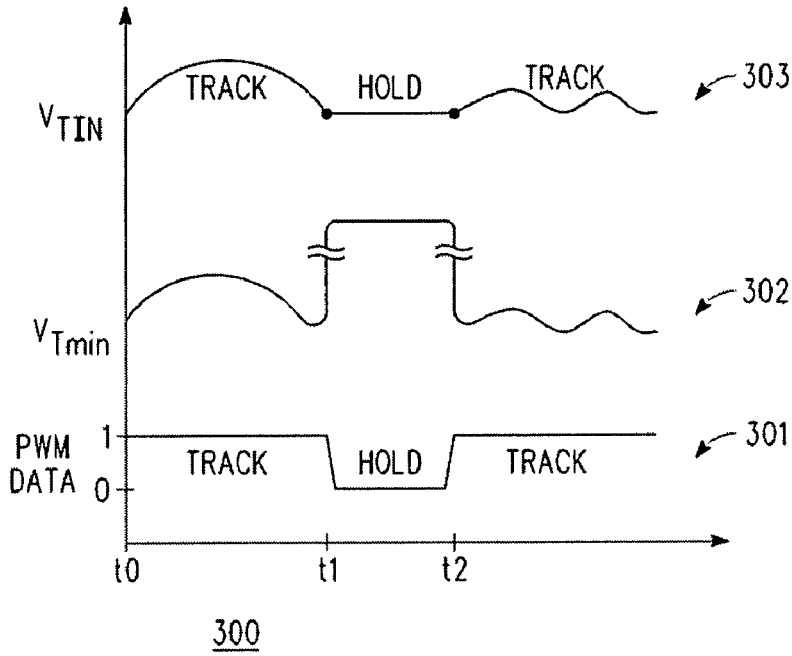
FIG. 3 is a chart illustrating an example operation of a track/hold circuit of the feedback controller of FIG. 2 in accordance with at least one embodiment of the present disclosure.

FIG. 3 illustrates a chart 300 depicting an example relationship between the PWM data 120 (line 301), the minimum tail voltage $V_{Tmin}$ (line 302) of the LED strings 105-107 (FIG. 1), and the reference voltage $V_{TIN}$ (line 303) used by the error comparator 202 (FIG. 2) to control the output voltage $V_{OUT}$ based on its relationship with the reference voltage $V_{REF}$. The effects of short-term and long-term precharging are omitted from the example of FIG. 3 for ease of illustration.

In the illustrated example, the PWM data 120 transitions from the "high" state to the "low" state at time $t_1$ and transitions from the "low" state to the "high" state at time $t_2$. In the duration from time to $t_0$ time $t_1$, one or more of the LED strings 105-107 is active and the track/hold circuit 124 is in the track mode. Accordingly, the minimum tail voltage $V_{Tmin}$ is maintained at or near the reference voltage $V_{REF}$ with some variation due to changes in the forward voltages of the LED strings 105-107. Further, the minimum tail voltage $V_{Tmin}$ is provided as the reference voltage $V_{TIN}$ during the track mode and thus the reference voltage $V_{TIN}$ varies with the minimum tail voltage $V_{Tmin}$ between times to and $t_1$. At time $t_1$, the PWM data 120 enters the "low" state, thereby deactivating the LED strings 105-107. Thus, the tail voltages of the LED strings 105-107 are pulled substantially closer to the output voltage $V_{OUT}$ (e.g., pulled to 10-15 V) for the duration between times $t_1$ and $t_2$ and, consequently, the minimum tail voltage $V_{Tmin}$ is pulled closer to the output voltage $V_{OUT}$ for the duration between times $t_1$ and $t_2$. However, track/hold circuit 124 enters the hold mode for the duration between times $t_1$ and $t_2$, and thus the last tracked minimum tail voltage (i.e., the minimum tail voltage $V_{Tmin}$ at time $t_1$) is held for the duration between times $t_1$ and $t_2$ and this held voltage provided as the reference voltage $V_{TIN}$ for controlling the output voltage $V_{OUT}$. At time $t_2$ the PWM data 120 transitions back to the "high" state and thus the minimum tail voltage $V_{Tmin}$ drops back to near the reference voltage $V_{REF}$ for the duration following time $t_2$. Likewise, the track/hold circuit 124 reenters the track mode and tracks the minimum tail voltage $V_{Tmin}$ while providing in parallel the minimum tail voltage $V_{Tmin}$ as the voltage $V_{TIN}$ for controlling the output voltage $V_{OUT}$.

Figure 4:
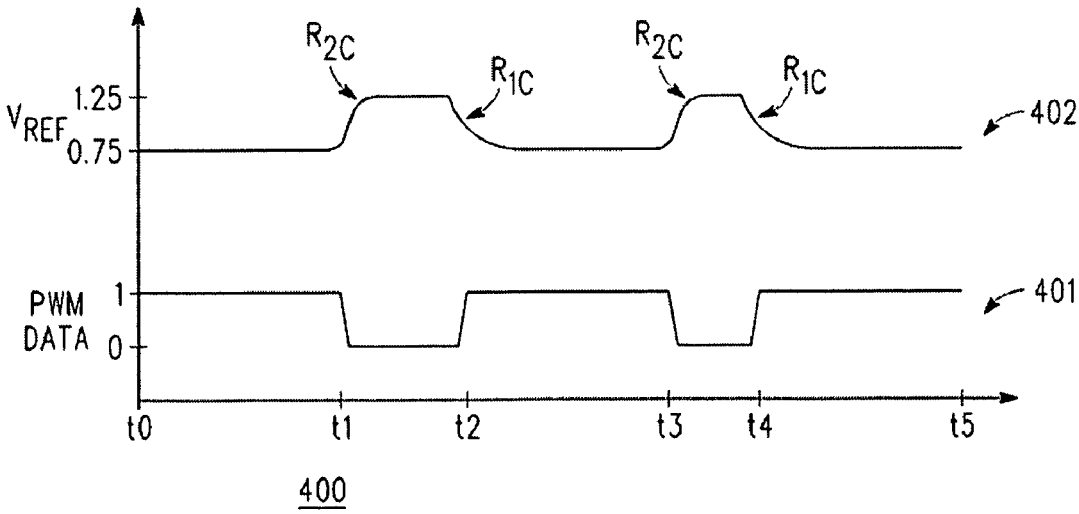
FIG. 4 is a chart illustrating an example operation of a short-term precharge circuit of the feedback controller of FIG. 2 in accordance with at least one embodiment of the present disclosure.

FIG. 4 illustrates a chart 400 depicting an example relationship between the PWM data 120 (line 401) and the reference voltage $V_{REF}$ (line 402) provided by the short-term precharge circuit 126 of FIG. 2. In the chart 400, the PWM data is in the "high" state between times $t_0$ and $t_1$, between times $t_2$ and $t_3$, and between times $t_4$ and $t_5$ and in the "low" state between times $t_1$ and $t_2$ and between times $t_3$ and $t_4$. Accordingly, one or more of the LED strings 105-107 (FIG. 1) are activated between times $t_0$ and $t_1$, between times $t_2$ and $t_3$, and between times $t_4$ and $t_5$ and the LED strings 105-107 are deactivated between times $t_1$ and $t_2$ and between times $t_3$ and $t_4$.

While the PWM data 120 is in the "high" state starting at time $t_0$, the short-term precharge circuit 126 is configured to supply the voltage $V_{R1}$ (e.g., 0.75 V) as the voltage $V_{REF}$. However, when the PWM data 120 transitions to the "low" state at time $t_1$ to deactivate the LED strings 105-107, the short-term precharge circuit 126 initiates the supply of the voltage $V_{R1}+V_{R2}$ (e.g., 1.25 V) as the voltage $V_{REF}$. The rate of the transition of $V_{REF}$ from the voltage $V_{R1}$ to $V_{R1}+V_{R2}$ at time $t_1$ is reflected by the time constant $R_2C$ as described above with reference to FIG. 2. In order to permit a rapid transition, a relatively low resistance $R_2$ can be selected. The short-term precharge circuit 126 maintains the reference voltage $V_{REF}$ at the voltage $V_{R1}+V_{R2}$ until the PWM data 120 transitions back to the "high" state at time $t_2$, at which point the short-term precharge circuit 126 initiates provision of the voltage $V_{R1}$ as the reference voltage $V_{REF}$. However, as discussed above, the rate of the transition of the reference voltage $V_{REF}$ from the voltage $V_{R1}+V_{R2}$ to the voltage $V_{R1}$ is reflected by the time constant $R_1C$. As it can be advantageous to gradually decrease the reference voltage $V_{REF}$ so as to compensate for the initial transient voltage droop in the output voltage $V_{OUT}$ caused by the activation of the LED strings 105-107 at time $t_2$, a relatively large resistance $R_1$ can be selected to provide a slower transition back to the voltage $V_{R1}$ for the reference voltage $V_{REF}$.

The terms "including", "having", or any variation thereof, as used herein, are defined as comprising. The term "coupled", as used herein with reference to electro-optical technology, is defined as connected, although not necessarily directly, and not necessarily mechanically. Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

controlling, at a light emitting diode (LED) driver, an output voltage provided to a head end of each of a plurality of LED strings based on a relationship between at least one tail voltage of the plurality of LED strings and a reference voltage;

receiving, at the LED driver, a pulse width modulation (PWM) data to control activation of the plurality of LED strings; and adjusting the reference voltage based on the PWM data.

2. The method of claim 1, wherein adjusting the reference voltage based on the PWM data comprises:

configuring the reference voltage to a first voltage responsive to the PWM data being in a first state, the first state to activate at least one LED string of the plurality of LED strings; and configuring the reference voltage to a second voltage greater than the first voltage responsive to the PWM data being in a second state, the second state to deactivate the plurality of LED strings.

3. The method of claim 2, wherein:

while the PWM data is in the first state:

tracking a minimum tail voltage of tail voltages of the plurality of LED strings to determine a tracked minimum tail voltage; and adjusting the output voltage based on a relationship between the reference voltage and the tracked minimum tail voltage; and while the PWM data is in the second state:

holding a minimum tail voltage of tail voltages of the plurality of LED strings occurring at a transition of the PWM data from the first state to the second state to determine a held minimum tail voltage; and adjusting the output voltage for the duration of the second state based on a relationship between the reference voltage and the held minimum tail voltage.

4. The method of claim 1, wherein:

while the PWM data is in the first state:

tracking a minimum tail voltage of tail voltages of the plurality of LED strings to determine a tracked minimum tail voltage; and adjusting the output voltage based on a relationship between the reference voltage and the tracked minimum tail voltage; and while the PWM data is in the second state:

holding a minimum tail voltage of tail voltages of the plurality of LED strings occurring at a transition of the PWM data from the first state to the second state to determine a held minimum tail voltage;

adjusting the held minimum tail voltage based on an average PWM duty ratio of the PWM data over a predetermined averaging duration to generate an adjusted minimum tail voltage; and adjusting the output voltage for the duration of the second state based on a relationship between the reference voltage and the adjusted minimum tail voltage.

5. The method of claim 1, wherein:

determining a minimum tail voltage of tail voltages of the plurality of LED strings responsive to the output voltage; and adjusting the output voltage based on a relationship between the minimum tail voltage and the reference voltage.

6. The method of claim 5, wherein adjusting the output voltage based on the relationship comprises:

increasing the output voltage responsive to the minimum tail voltage being less than the reference voltage; and decreasing the output voltage responsive to the minimum tail voltage being greater than the reference voltage.

7. A method comprising:

providing an output voltage to a head end of each of a plurality of light-emitting diode (LED) strings, the output voltage based on a relationship between a first reference voltage and a second reference voltage;

receiving, at a light emitting diode (LED) driver, a pulse width modulation (PWM) data to control activation of the plurality of LED strings, the PWM data comprising a first state to activate at least one LED string of the plurality of LED strings and a second state to deactivate the plurality of LED strings;

while the PWM data is in the first state, tracking the first reference voltage to a minimum tail voltage of tail voltages of the plurality of LED strings to determine a tracked minimum tail voltage and providing the tracked minimum tail voltage as the first reference voltage; and while the PWM data is in the second state, holding the first reference voltage to a minimum tail voltage of tail voltages of the plurality of LED strings occurring at a transition of the PWM data from the first state to the second state.

8. The method of claim 7, further comprising:

setting the second reference voltage to a first voltage level responsive to the PWM data being in the first state; and setting the second reference voltage to a second voltage level responsive to the PWM data being in the second state, the second voltage level greater than the first voltage level.

9. The method of claim 7, wherein providing the output voltage comprises:

increasing the output voltage responsive to the first reference voltage being less than the second reference voltage; and decreasing the output voltage responsive to the first reference voltage being greater than the second reference voltage.

10. The method of claim 7, further comprising:

while the PWM data is in the first state, regulating each activated LED string of the plurality of LED strings based to a predetermined current.

11. A system comprising:

a light emitting diode (LED) driver comprising:

a voltage controller configured to control adjustment of an output voltage provided to a head end of each of a plurality of LED strings based on a relationship between at least one tail voltage of the plurality of LED strings and a first reference voltage;

an input to receive a pulse width modulation (PWM) data to control activation of the plurality of LED strings; and a first precharge circuit configured to adjust the first reference voltage responsive to a state of the PWM data.

12. The system of claim 11, wherein the first precharge circuit is configured to:

provide a first voltage as the first reference voltage responsive to the PWM data being in a first state, the first state to activate at least one LED string of the plurality of LED strings; and provide a second voltage as the first reference voltage responsive to the PWM data being in a second state, the second state to deactivate the plurality of LED strings and the second voltage greater than the first voltage.

13. The system of claim 11, wherein the first precharge circuit comprises:

an output node coupled to the voltage controller to provide the first reference voltage;

a first power source comprising an anode and a cathode, the cathode coupled to a ground reference;

a second power source comprising an anode and a cathode, the cathode coupled to the anode of the first power source;

a capacitor comprising a first electrode coupled to the output node and a second electrode coupled to the ground reference;

a first resistor comprising a first electrode coupled to the anode of the first power source and a second electrode;

a second resistor comprising a second electrode coupled to the anode of the second voltage and a second electrode;

a first switch comprising a first node coupled to the second electrode of the first resistor and a second node coupled to the output node, the first switch controlled by the PWM data; and a second switch comprising a first node coupled to the second electrode of the second resistor and a second node coupled to the output node, the second switch controlled by a complementary representation of the PWM data.

14. The system of claim 11, wherein the voltage controller comprises:

an error amplifier comprising a first input configured to receive the first reference voltage, a second input configured to receive a second reference voltage, and an output configured to provide an error signal representative of a relationship between the first reference voltage and the second reference voltage; and the system further comprising:

a track/hold circuit configured to:

while the PWM data is in a first state, track the second reference voltage to a minimum tail voltage of tail voltages of the plurality of LED strings, the first state to activate at least one LED string of the plurality of LED strings; and while the PWM data is in a second state, hold the second reference voltage to a minimum tail voltage of tail voltages of the plurality of LED strings occurring at a transition of the PWM data from the first state to the second state, the second state to deactivate the plurality of LED strings.

15. The system of claim 11, wherein the voltage controller comprises:

an error amplifier comprising a first input configured to receive the first reference voltage, a second input configured to receive a second reference voltage, and an output configured to provide an error signal representative of a relationship between the first reference voltage and the second reference voltage; and the system further comprising:

a second precharge circuit configured to adjust the second reference voltage based on an average duty cycle of the PWM data over a predetermined duration.

16. The system of claim 15, wherein the second precharge circuit is configured to:

increase the second reference voltage responsive to a decrease in the average duty cycle; and decrease the second reference voltage responsive to an increase in the average duty cycle.

17. A system comprising:

a light emitting diode (LED) driver comprising:

a voltage controller configured to control adjustment of an output voltage provided to a head end of each of a plurality of LED strings based on a relationship between at least one tail voltage of the plurality of LED strings and a first reference voltage;

an input to receive a pulse width modulation (PWM) data to control activation of the plurality of LED strings, the PWM data comprising a first state to activate at least one LED string of the plurality of LED strings and a second state to deactivate the plurality of LED strings; and a track/hold circuit configured to:

while the PWM data is in the first state, track the first reference voltage to a minimum tail voltage of tail voltages of the plurality of LED strings; and while the PWM data is in a second state, hold the first reference voltage to a minimum tail voltage of tail voltages of the plurality of LED strings occurring at a transition of the PWM data from the first state to the second state.

18. The system of claim 17, wherein the track/hold circuit comprises:

an output node to provide the first reference voltage;

a minimum select circuit comprising an output to provide the minimum tail voltage of the tail voltages of the plurality of LED strings;

a resistor comprising a first electrode to receive the output voltage and a second electrode;

a current digital-to-analog converter (DAC) comprising a first electrode coupled to the second electrode of the resistor, a second electrode coupled to a ground reference, and a control input;

a comparator comprising a first input coupled to the second electrode of the resistor, a second input coupled to the output of the minimum select circuit, and an output;

an up/down counter comprising an input coupled to the output of the comparator and an output coupled to the control input of the current DAC;

a first switch comprising a first node coupled to the second electrode of the resistor and a second node coupled to the output node, the first switch controlled by a complementary representation of the PWM data; and a second switch comprising a first node coupled to the output of the minimum select circuit and a second node coupled to the output node, the second switch controlled by the PWM data.

19. The system of claim 17, further comprising:

a precharge circuit configured to output a representation of an average duty cycle of the PWM data over a predetermined duration; and wherein the track/hold circuit comprises:

an output node to provide the first reference voltage;

a minimum select circuit comprising an output to provide the minimum tail voltage of the tail voltages of the plurality of LED strings;

a resistor comprising a first electrode to receive the output voltage and a second electrode;

a current digital-to-analog converter (DAC) comprising a first electrode coupled to the second electrode of the resistor, a second electrode coupled to a ground reference, and a control input;

a comparator comprising a first input coupled to the second electrode of the resistor, a second input coupled to the output of the minimum select circuit, and an output;

an up/down counter comprising an input coupled to the output of the comparator and an output;

a summer comprising a first input coupled to the output of the precharge circuit, a second input coupled to the output of the up/down counter, and an output coupled to a current source;

a first switch comprising a first node coupled to the second electrode of the resistor and a second node coupled to the output node, the first switch controlled by a complementary representation of the PWM data; and a second switch comprising a first node coupled to the output of the minimum select circuit and a second node coupled to the output node, the second switch controlled by the PWM data.

20. The system of claim 17, further comprising:

a voltage regulator configured to generate the output voltage; and a LED panel comprising the plurality of LED strings.

* * * * *